US009803632B2

(12) United States Patent
Chou

(10) Patent No.: US 9,803,632 B2
(45) Date of Patent: Oct. 31, 2017

(54) AIR COMPRESSOR OF WEIGHT-REDUCTION TYPE

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 285 days.

(21) Appl. No.: 14/686,779

(22) Filed: Apr. 15, 2015

(65) Prior Publication Data

US 2015/0300342 A1 Oct. 22, 2015

(30) Foreign Application Priority Data

Apr. 22, 2014 (TW) ..... 103114591 A

(51) Int. Cl.

| | |
|---|---|
| ***F04B 53/10*** | (2006.01) |
| ***F04B 39/12*** | (2006.01) |
| ***F04B 35/04*** | (2006.01) |
| ***F04B 39/00*** | (2006.01) |
| ***F04B 35/01*** | (2006.01) |
| ***F04B 53/08*** | (2006.01) |
| ***F04B 53/14*** | (2006.01) |

(52) U.S. Cl.

CPC ..... *F04B 39/12* (2013.01); *F04B 35/01* (2013.01); *F04B 35/04* (2013.01); *F04B 39/0027* (2013.01); *F04B 39/0094* (2013.01); *F04B 39/121* (2013.01); *F04B 53/08* (2013.01); *F04B 53/10* (2013.01); *F04B 53/14* (2013.01); *F05C 2225/00* (2013.01)

(58) Field of Classification Search

CPC ..... F04B 35/04; F04B 39/066; F04B 39/125; F04B 39/127

See application file for complete search history.

(56) References Cited

U.S. PATENT DOCUMENTS

| | | | | |
|---|---|---|---|---|
| 6,135,725 A * | 10/2000 | Chou | F04B 35/04 | 417/360 |
| 6,783,333 B2 * | 8/2004 | Wang | F04B 35/01 | 417/307 |
| 7,240,642 B2 * | 7/2007 | Chou | F04B 39/123 | 123/41.35 |
| 7,976,290 B2 * | 7/2011 | Wang | F04B 35/01 | 248/300 |
| 7,977,835 B2 * | 7/2011 | Simofi-Ilyes | F04D 25/082 | 310/238 |
| 8,297,944 B2 * | 10/2012 | Chou | F04B 35/008 | 285/33 |
| 9,435,331 B2 * | 9/2016 | Chou | F04B 39/122 | |

* cited by examiner

*Primary Examiner* — Patrick Hamo

(57) ABSTRACT

An air compressor of weight-reduction type is disclosed, wherein the bearing and the main housing thereof are formed integrally, so that when the piston body conducts reciprocating motion within the cylinder at high frequencies, the bearing is firmly fixed on the main housing without nonfunctioning or falling off. Furthermore, the main housing and the cylinder thereof are made of plastic and formed integrally. The main housing is formed with a wind collecting hood to facilitate the air flow being introduced through the main housing for rapidly dissipating the heat generated by the bearing and the heat generated from the reciprocating motion of the piston body. Accordingly, the manufacturing cost of the air compressor can be reduced to achieve an economical design, and the weight of the air compressor can be reduced to facilitate the compressor being carried onto a vehicle.

6 Claims, 8 Drawing Sheets

AIR COMPRESSOR OF WEIGHT-REDUCTION TYPE

(a) TECHNICAL FIELD OF THE INVENTION

The present invention relates to an air compressor of weight-reduction type and, more particularly, to an improved air compressor, wherein the bearing and the main housing thereof are formed integrally, so that when the piston body conducts reciprocating motion within the cylinder at high frequencies, the bearing is firmly fixed on the main housing without nonfunctioning or falling off; furthermore, the main housing and the cylinder thereof are made of plastic and formed integrally, therefore, due to the main housing and the cylinder being made of non-metallic material, the manufacturing cost of the air compressor can be reduced to achieve an economical design, and the weight of the air compressor can be reduced to facilitate the compressor being carried onto a vehicle.

(b) DESCRIPTION OF THE PRIOR ART

FIGS. 6 and 7 show a conventional air compressor 8, which basically comprises a base 81, a cylinder 82 joined to the base 81, a motor 83 mounted to the base 81, and a piston 84 fitted to the cylinder 82. Through a gear mechanism 85 and a crank mechanism, the motor 83 can drive the piston 84 to conduct reciprocating motion within the cylinder 82. The reciprocating motion includes an intake stroke for allowing air to enter the cylinder 82 and a compression stroke for compressing air in the cylinder 82 and forcing the compressed air out of the cylinder 82.

The gear mechanism 85 includes a first gear 851 (i.e., the driving gear), which is mounted at an axle 831 of the motor 83, and a second gear 852 (i.e., the driven gear) engaged with the first gear 851. The crank mechanism includes a counterweight 861 provided at the second gear 852, a crankshaft 862, and a crankpin 863. One end of the crankshaft 862 is fixed to a center of the second gear 852, and the other end of the shaft 862 is fitted to a bearing 811 that is mounted in a mounting hole 810. The crankpin 863 is fixed to the counterweight 861. The piston 84 is connected to the crankpin 863 such that the hole 843 defined at the bottom end 842 of the rod portion 841 is fitted around the crankpin 863. Since the crankpin 863 is offset from the crankshaft 862, when the second gear 852 is rotated by the first gear 851, the crankpin 863 can be driven to swing in a circle around the crankshaft 862, which allows the piston 84 to conduct reciprocating motion within the cylinder 82.

However, in the conventional air compressor 8, due to the distance between the cylinder 82 and the base 81 is too long, the reciprocating motion of the piston 84 is often changed in its motion path. Therefore, the performance of compressing air and the service life of the conventional air compressor will be reduced. In more detail, as shown in FIG. 7, the gear mechanism 85 is located between the cylinder 82 and the base 81, wherein the distance between the center of the cylinder 82 and the base 81 is indicated by the symbol (D). Due to the distance (D) being longer than a suitable length for the crankshaft 862, the mounting hole 810 is liable to undergo a greater force at some area of the mounting hole 810 during the reciprocating motion of the piston 84. As the piston 84 continues conducting reciprocating motion, the mounting hole 810 will be gradually worn out. Thus, the rotational center of the crankshaft 862 will not be fixed. The motion path of the crankshaft 862 is schematically indicated by the symbol (A) in FIG. 8, while the motion path of the crankpin 863 is schematically indicated by the symbol (C) in FIG. 8, which is non-circular. Thus, when the piston 84 conducts reciprocating motion within the cylinder 82, the motion path of the piston 84 will be changed, as shown by the dashed lines in FIG. 7, and this will cause the head of the piston 84 and the bearing 811 mounted in the hole 810 to be damaged, thereby reducing the service life of the air compressor.

SUMMARY OF THE INVENTION

In view of the foregoing, one object of the present invention is to provide an air compressor of weight-reduction type, which can increase the motion stability of the piston body thereof, wherein the bearing and the main housing thereof are formed integrally, and the main housing and the cylinder thereof are made of plastic and formed integrally, so as to mitigate the defect of the conventional air compressor and increase the service life of the air compressor; furthermore, due to the main housing and the cylinder being made of non-metallic material, the manufacturing cost and the weight of the air compressor can be reduced.

Another object of the present invention is to provide an air compressor of weight-reduction type, wherein the main housing defines two through holes, respectively at two opposite sides of the area generally formed by the first and second portions of the main housing, which can guide the air flow generated by the cooling fan to flow through the main housing. The main housing is formed with two lateral walls and a bottom wall. Each of the lateral walls includes a curved upper section and a straight lower section, and thus the two lateral walls form an inverted U-shaped structure. The bottom wall includes a C-shaped section and two short sections at two opposite ends of the C-shaped section. The straight lower section of each lateral wall is joined with one of the short section of the bottom wall, and thus the two lateral walls and the bottom wall form a wind collecting hood. The second portion is located within the wind collecting hood, and multiple radial braces are formed between the second portion and the wind collecting hood so as to facilitate the air flow, especially the spiral component thereof, generated by the cooling fan, being introduced through the main housing for rapidly dissipating the heat generated from the reciprocating motion of the piston body, so that the operational security can be increased.

A further object of the present invention is to provide an air compressor of weight-reduction type, wherein the open bottom of the cylinder is divided into two halves according to a central vertical line of the cylinder, wherein one half of the open bottom is horizontal while the other half of the open bottom is slanted.

A still further object of the present invention is to provide an air compressor of weight-reduction type, wherein the air storage unit and the cylinder thereof are formed integrally.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
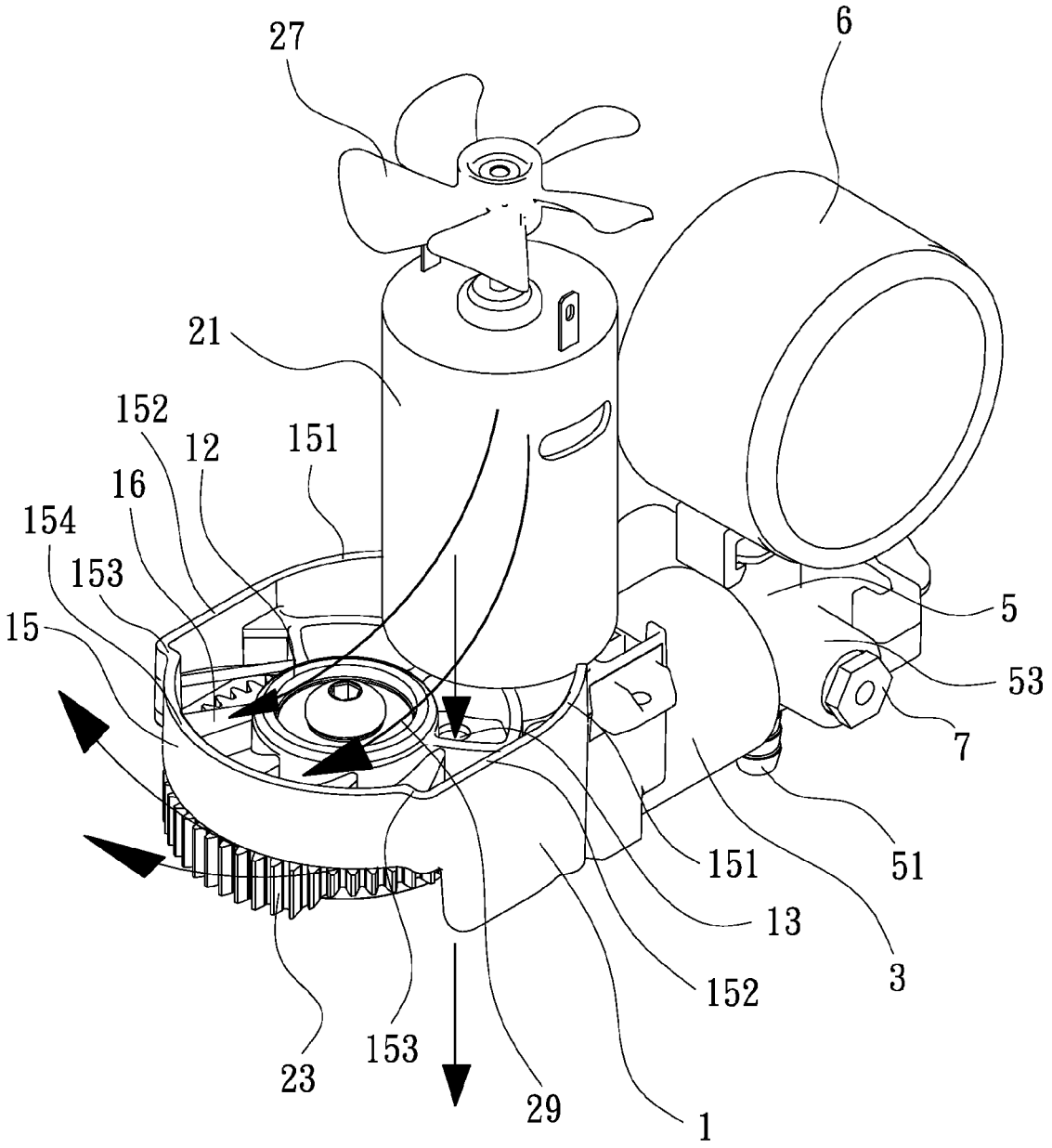
FIG. 1 shows a 3-dimensional view of an air compressor of weight-reduction type according to one embodiment of the present invention.
Figure 2:
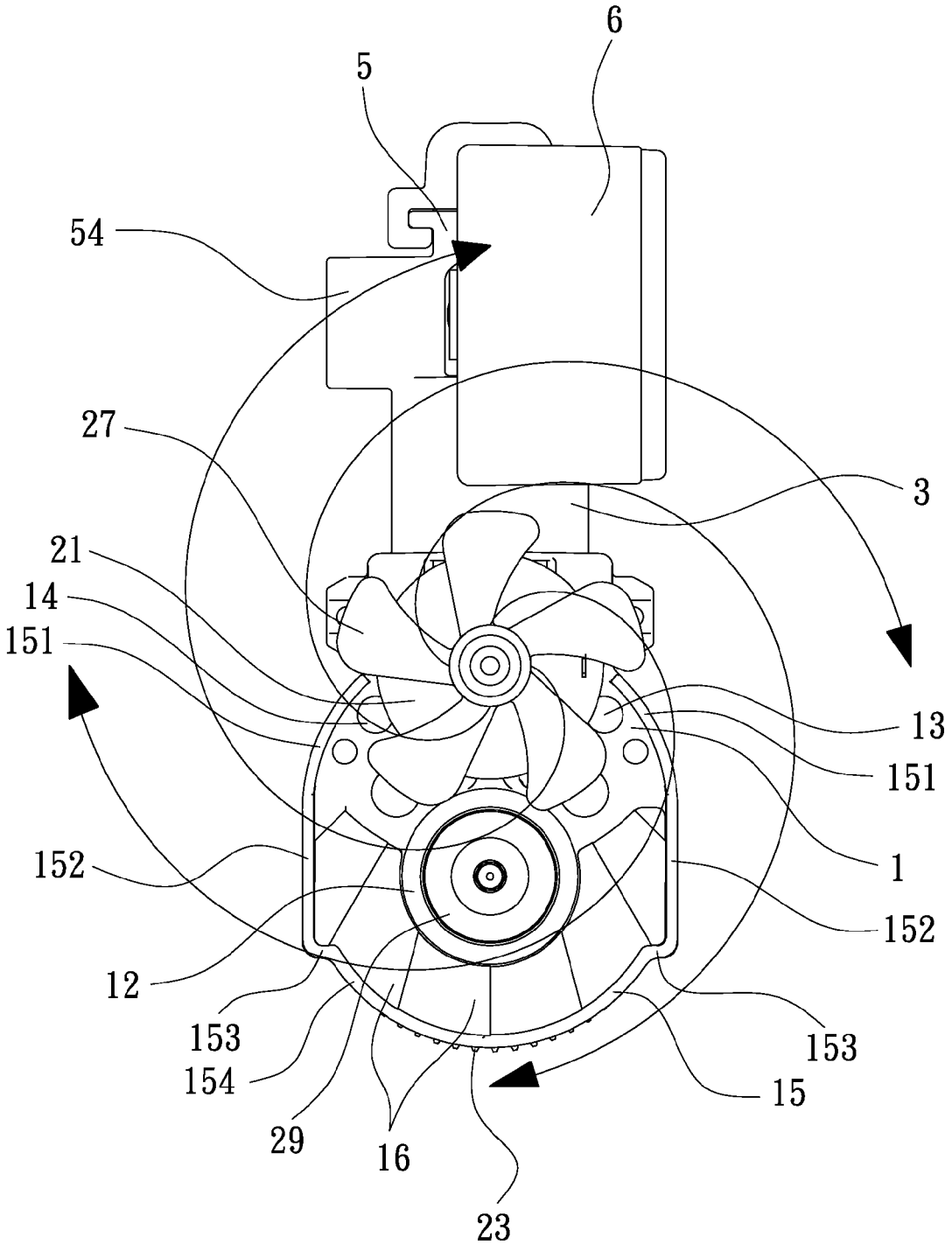
FIG. 2 shows a rear view of the air compressor of weight-reduction type of the embodiment.

Referring to FIGS. 1 through 4, an air compressor of weight-reduction type according to one embodiment of the present invention is shown, which generally comprises a main housing 1, a cylinder 3 joined to the main housing 1, a power mechanism mounted to the main housing 1, and a piston body 25 fitted in the cylinder 3 and driven by the power mechanism to conduct reciprocating motion within the cylinder 3. The piston body 25 contains a piston head 26 being integrally formed therewith.

The power mechanism includes a motor 21, a small gear 22, a large gear 23, a counterweight 28 fixed with a crankpin 24, and a cooling fan 27.

Figure 3:
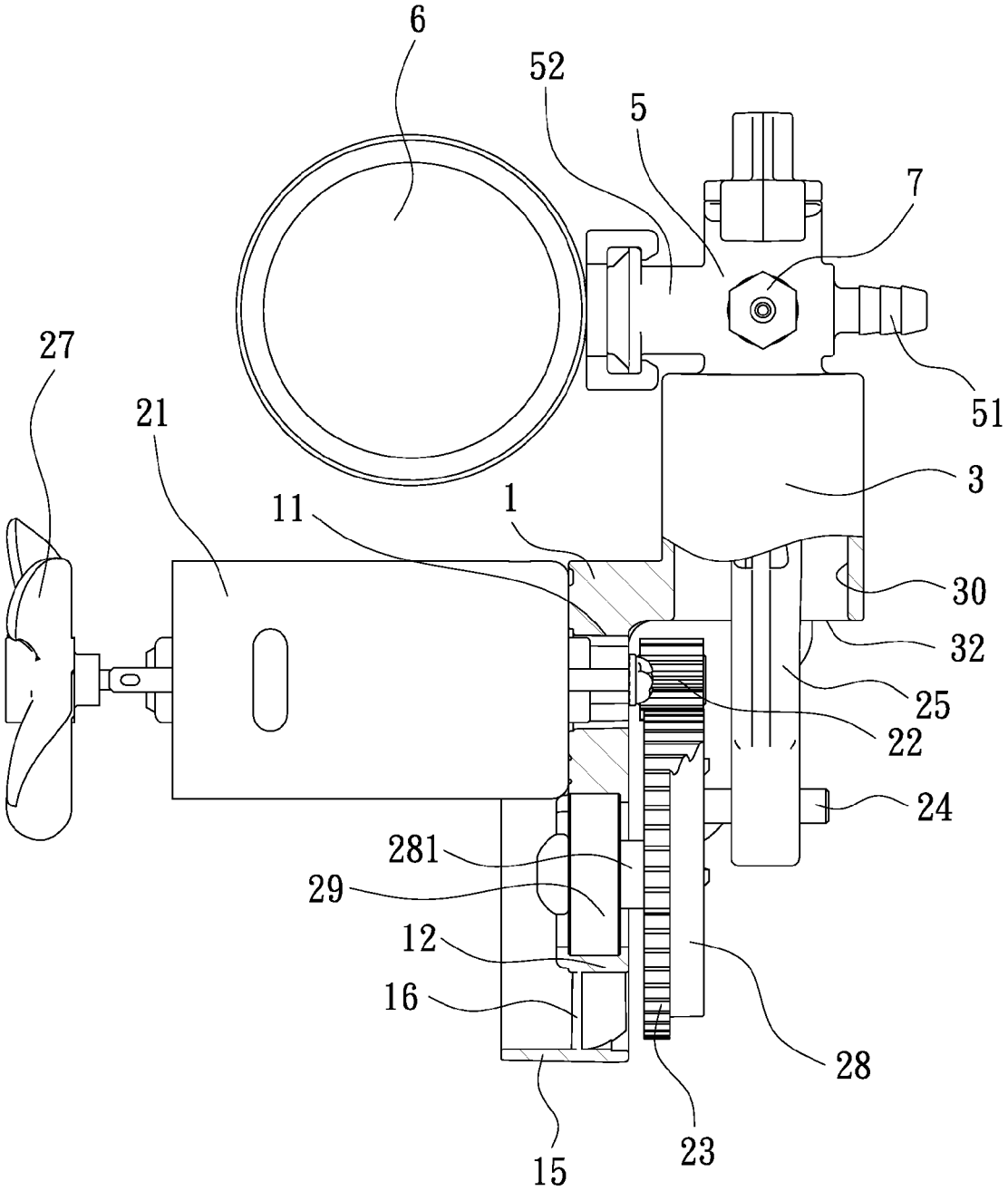
FIG. 3 shows a partially sectional view of the air compressor of weight-reduction type of the embodiment.

The main housing 1, which can be made of plastic, is provided with a first portion 11 and a second portion 12 (see FIG. 3). The first portion 11 is provided for mounting the motor 21 fitted with a small gear 22 at an axle thereof. A cooling fan 27 is provided at a rear end of the axle of the motor 21. The large gear 23 is provided with the counterweight 28 being fixed with a crankshaft 281 and a crankpin 24. Specifically, the counterweight 28 is mounted in a central opening of the large gear 23 and flush with the large gear 23 so as to reduce the distance between the main housing 1 and the cylinder 3. The bearing 29, which can be a ball bearing, is formed integrally with the second portion 12 of the main housing 1. In manufacturing the air compressor, the bearing 29 can be placed in a cavity of a mold for the main housing 1, which is then introduced with molten plastic, and thus the bearing 29 can be formed integrally with the main housing 1 after the plastic is hardened. The crankshaft 281 is fixed at one end to the counterweight 28 and mounted at the other end to the bearing 29. The bottom end of the piston body 25 is fitted around the crankpin 24. The small gear 22 fitted on the axle of the motor 21 is engaged with the large gear 23. The main housing 1 defines two through holes 13, 14, respectively at two opposite sides of the area generally formed by the first and second portions 11, 12, which can guide the air flow generated by the cooling fan 27, to flow through the main housing 1. Furthermore, the main housing 1 is formed with two lateral walls and a bottom wall. Each of the lateral walls includes a curved upper section 151 and a straight lower section 152, and thus the two lateral walls form an inverted U-shaped structure. The bottom wall includes a C-shaped section 154 and two short sections 153 at two opposite ends of the C-shaped section 154. The straight lower section 152 of each lateral wall is joined with one of the short section 153 of the bottom wall, and thus the two lateral walls and the bottom wall form a wind collecting hood 15. The second portion 12 is located within the wind collecting hood 15, and multiple radial braces 16 are formed between the second portion 12 and the wind collecting hood 15 so as to facilitate the air flow, especially the spiral component thereof, generated by the cooling fan 27, being introduced through the main housing 1 for rapidly dissipating the heat generated by the bearing 29 and the heat generated from the reciprocating motion of the piston body 25 within the cylinder 3.

Both the cylinder 3 and the main housing 1 can be made of plastic. The cylinder 3 can be integrally formed with the main housing 1 or joined with the main housing 1 by using bonding technology (see FIG. 4). Furthermore, the air storage unit 5 can be formed integrally with the cylinder 3, wherein the air storage unit 5 is formed on the top wall 31 of the cylinder 3. The top wall 31 of the cylinder 3 defines a through hole 310 communicating with the air storage unit 5 and the inner space 34 of the cylinder 3. A valve plug 41 is located in the air storage unit 5 above the through hole 310 of the top wall 31 of the cylinder 3 and biased by a compression spring 42 thereon. As such, the motor 21 can drive the crankpin 24, via the small gear 22 and the large gear 23, to swing in a circle around the crankshaft 281, which allows the piston body 25 to conduct reciprocating motion within the cylinder 3 so as to produce compressed air in the inner space 34 of the cylinder 3. The compressed air can overcome the biasing force of the compression spring 42 to enter the air storage unit 5 via the through hole 310. Furthermore, the air storage unit 5 is provided with multiple connection fittings 51, 52, 53 and 54, through which the compressed air can be delivered to various application objects of different functions or features. For example, the connection fitting 51 can be connected with a hose (not shown), the connection fitting 52 can be connected with a pressure gauge 6, and the connection fitting 53 can be connected with a safety valve 7.

Preferably, the top surface of the piston head 26 is configured with a slope. With such feature, the force required for moving the piston body 25 at BDC (bottom dead center) or TDC (top dead center) can be reduced, and the gas-tightness between the piston head 26 and the cylinder 3 can be increased after the piston body 25 passes BDC or TDC, so that the reciprocating motion of the piston body 25 can be conducted more smoothly and the performance of compressing air can be increased.

Figure 4:
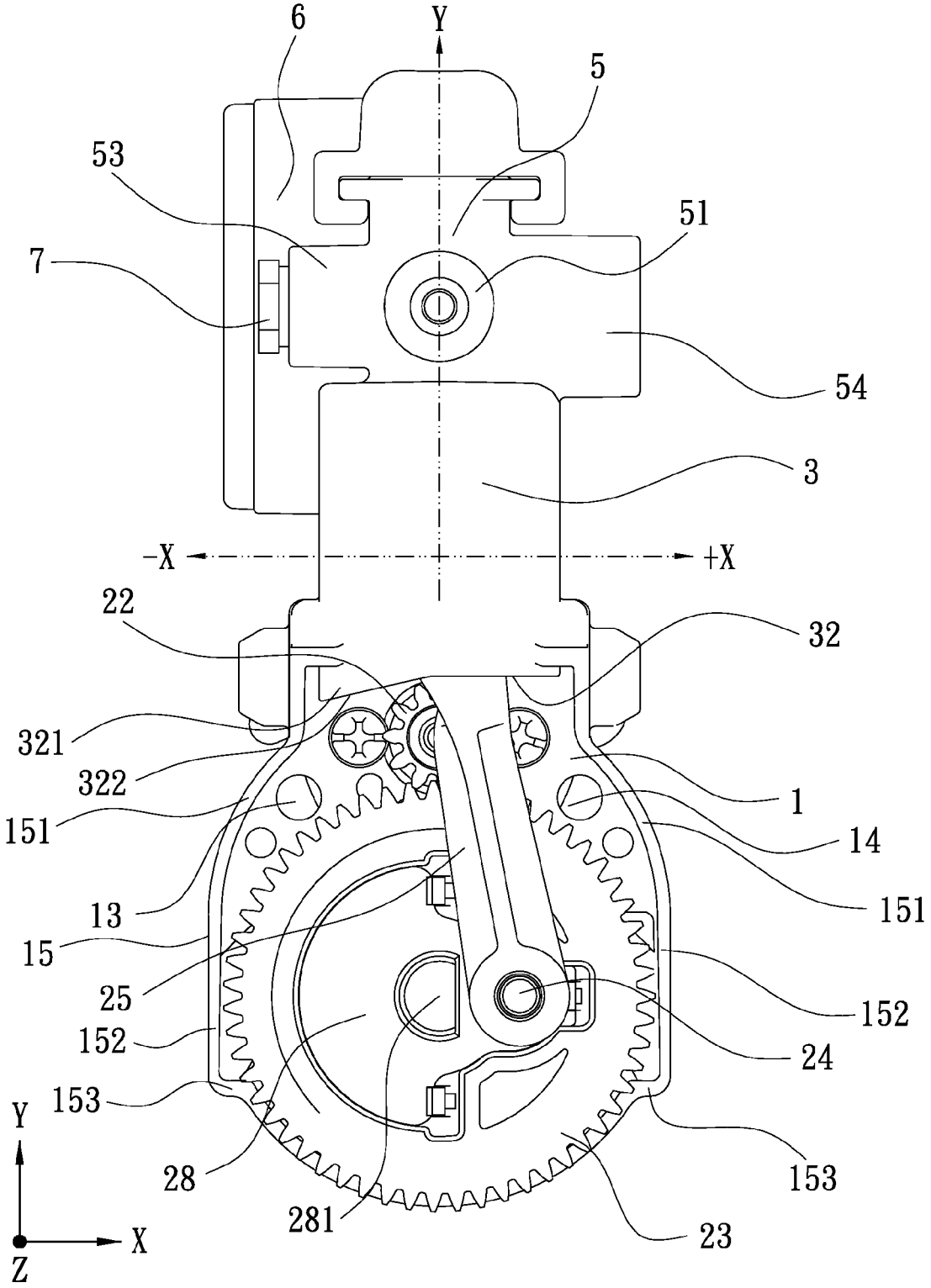
FIG. 4 shows a front view of the air compressor of weight-reduction type of the embodiment.
Figure 5:
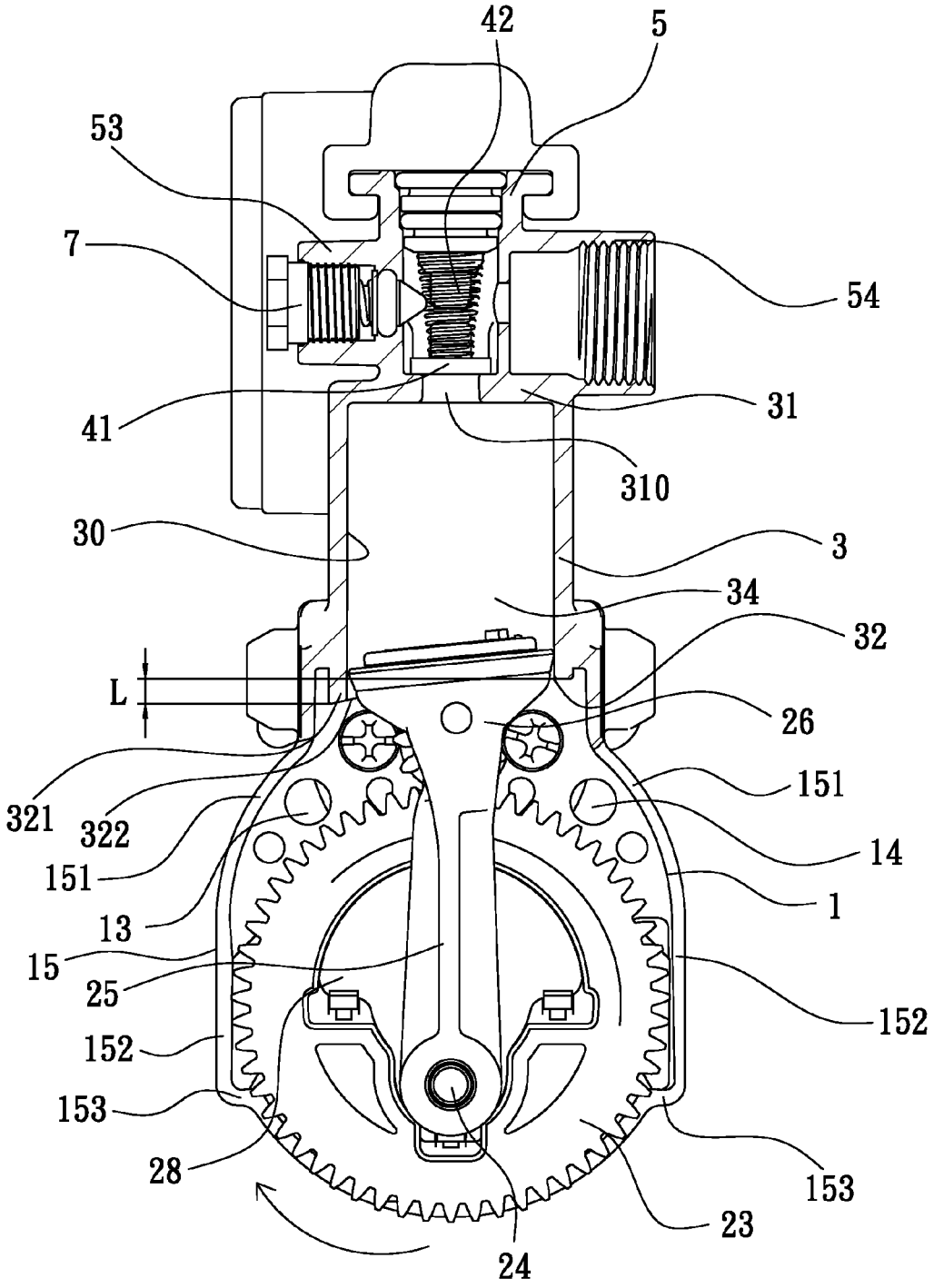
FIG. 5 shows a sectional view of the air compressor of weight-reduction type of the embodiment
Figure 6:
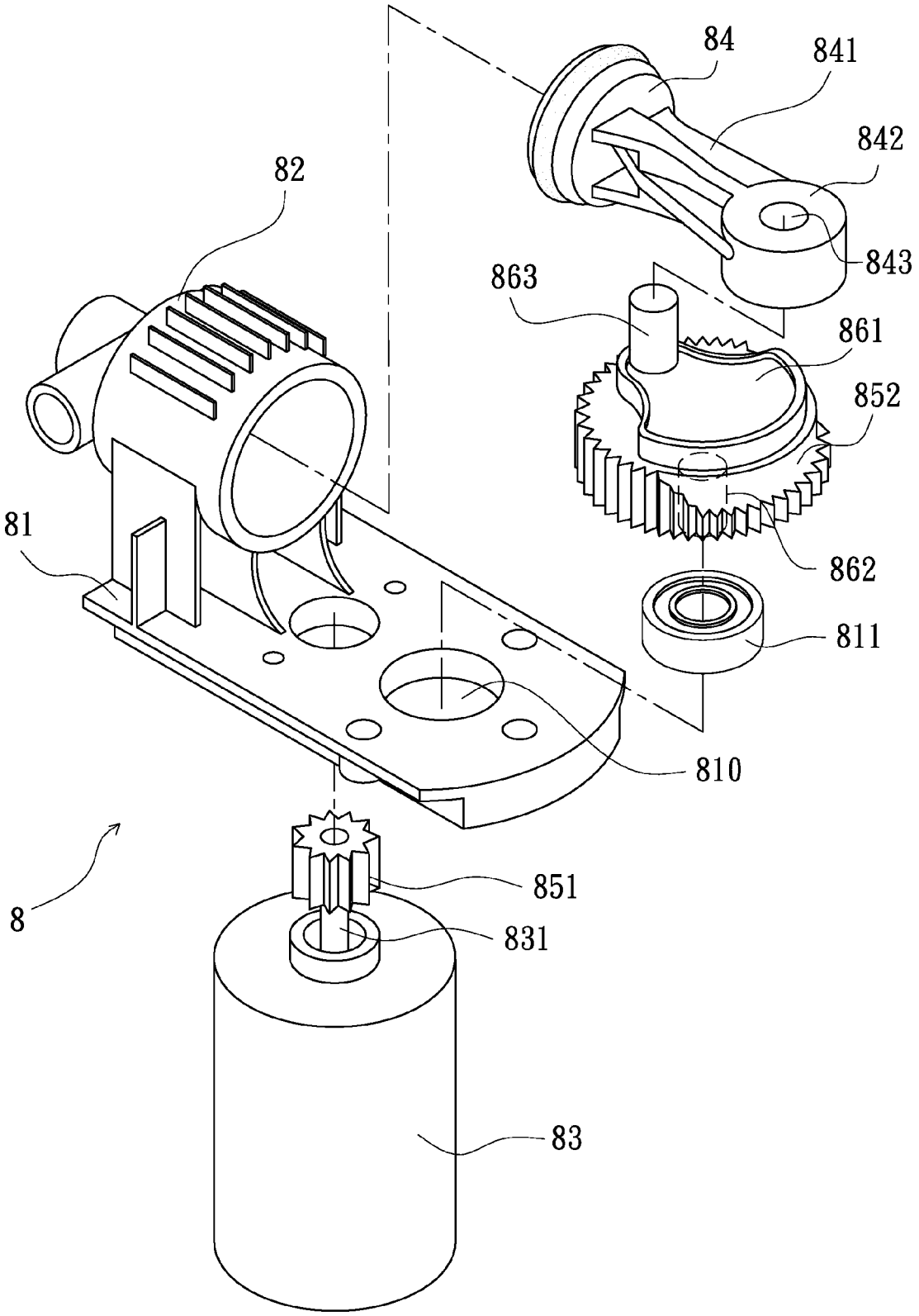
FIG. 6 Prior Art
FIG. 6 shows an exploded view of a prior-art air compressor.
Figure 7:
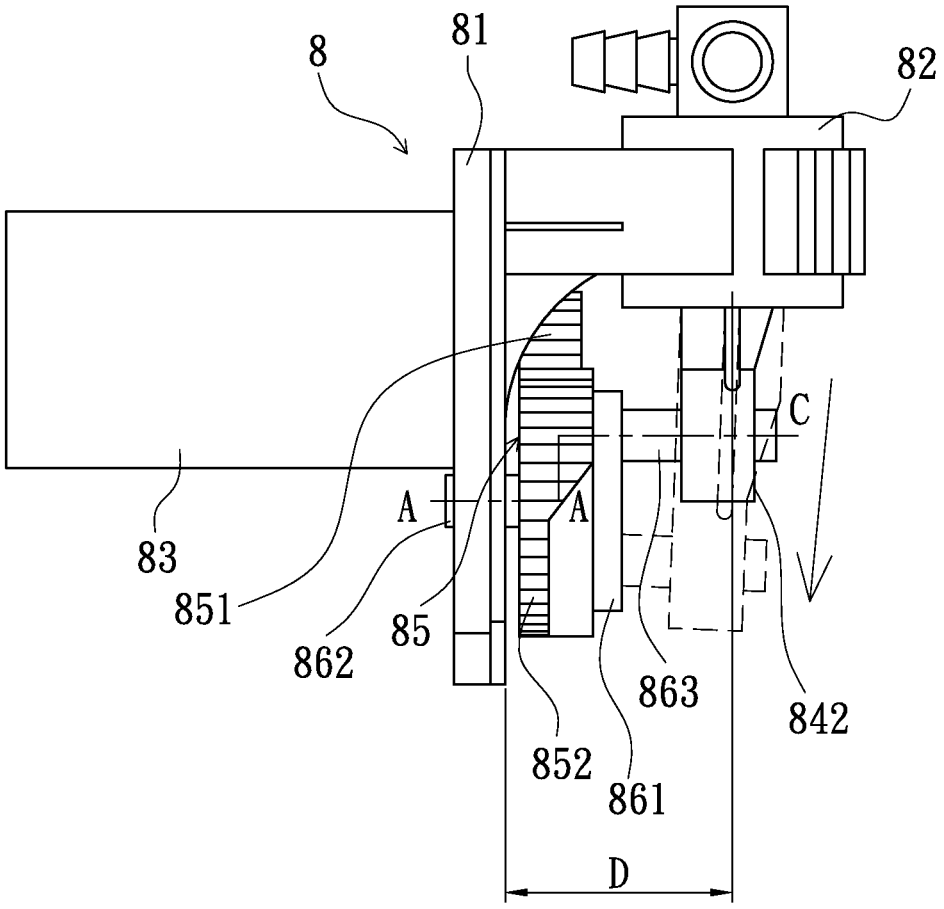
FIG. 7 Prior Art
FIG. 7 shows a schematic view of the prior-art air compressor, wherein the motion path of the piston is indicated by dashed lines.
Figure 8:
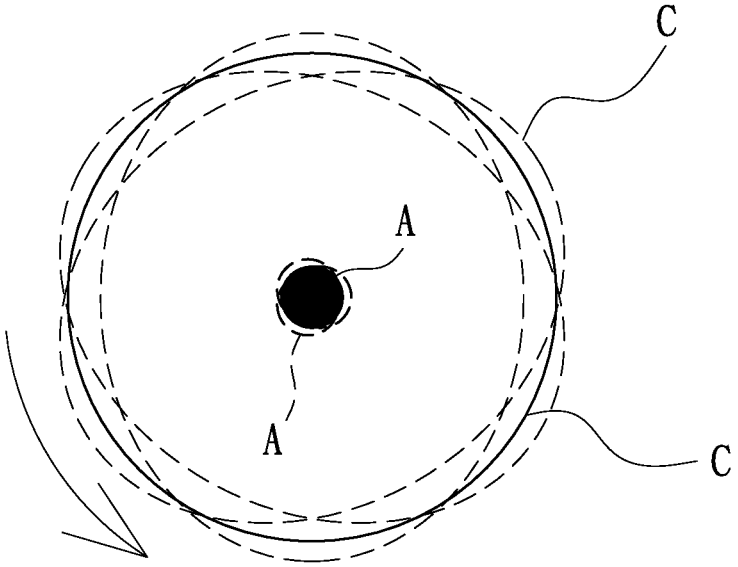
FIG. 8 Prior Art
FIG. 8 shows a schematic view of the motion paths of the crankshaft and the crankpin used in the prior-art air compressor.

The cylinder 3 of the air compressor has an open bottom 32. Referring to FIG. 4, a vertical central line (Y) of the cylinder 3 is used to divide a horizontal line (X) into a positive segment (+X) and a negative segment (−X). As shown, the open bottom 32 of the cylinder 3 is divided into two halves by using the vertical central line (Y) as a dividing line, wherein one half of the open bottom 32 corresponding to the positive segment (+X) is horizontal and parallel to the plane (X-Z))(where Z is an axis perpendicular to both the X-axis and Y-axis), while the other half of the open bottom 32 corresponding to the negative segment (−X) is slanted, and thus an extension portion 321 of the surrounding wall of the cylinder 3, with a slanted bottom 322, is formed. Preferably, the slanted bottom 322 is parallel to the top surface of the piston head 26 when the piston body 25 is at BDC (bottom dead center) or TDC (top dead center). As shown in FIG. 5, the distance between the lowest point of the slanted bottom 322 and the horizontal bottom is indicated by the symbol (L).

Furthermore, the slanting direction of the top surface of the piston head 26 as well as the slanted bottom 322 depends on the rotational direction of the large gear 23. For example, as shown in FIG. 5, when the rotation of the large gear 23 is clockwise and the slanted bottom 322 is at the left side of the cylinder 3, both the top surface of the piston head 26 and the slanted bottom 322 will be slanted up from the left to the right. On the other hand, if the rotation of the large gear 23 is counterclockwise and the slanted bottom 322 is at the right side of the cylinder 3, then both the top surface of the piston head 26 and the slanted bottom 322 will be slanted up from the right to the left.

As mentioned above, the piston body 25 of the air compressor can conduct reciprocating motion within the cylinder 3. In FIG. 5, the piston body 25 has conducted a downward motion, and the piston body 25 is at BDC (bottom dead center). At this moment, the top surface of the piston head 26 is parallel to the slanted bottom 322 of the cylinder 3, and the piston head 26 is entirely within the open bottom 32 of the cylinder 3, so that the piston head 26 will not escape from the cylinder 3 and thus can keep gas-tight with the inner surface 30 of the surrounding wall of the cylinder 3, so that the performance of compressing air and the operational security can be increased.

As a summary, the present invention provides an air compressor of weight-reduction type, which is featured in that the bearing 29 is formed integrally with the main housing 1. Preferably, the main housing 1 and the cylinder 3 are made of plastic and formed integrally. Furthermore, the main housing 1 defines two through holes 13, 14 respectively at two opposite sides of the area generally formed by the first and second portions 11, 12 for guiding the air flow generated by the cooling fan 27 to flow through main housing 1. The main housing is formed with two lateral walls and a bottom wall. Each of the lateral walls includes a curved upper section 151 and a straight lower section 152, and thus the two lateral walls form an inverted U-shaped structure. The bottom wall includes a C-shaped section 154 and two short sections 153 at two opposite ends of the C-shaped section 154. The straight lower section 152 of each lateral wall is joined with one of the short section 153 of the bottom wall, and thus the two lateral walls and the bottom wall form a wind collecting hood 15. The second portion 12 is located within the wind collecting hood 15, and multiple radial braces 16 are formed between the second portion 12 and the wind collecting hood 15 so as to facilitate the air flow, generated by the cooling fan 27, being introduced through the main housing 1 for rapidly dissipating the heat generated by the bearing 29 and the heat generated from the reciprocating motion of the piston body 25 within the cylinder 3, so as to increase the operational security. Furthermore, the main housing 1 and the cylinder 3 of the air compressor are made of non-metallic material, so that the weight and the manufacturing cost of the air compressor can be reduced, thereby achieving an economic design.

I claim:

1. An improved air compressor of the type including a main housing, a cylinder being fitted with a piston body having a piston head, an air storage unit communicating with the cylinder, a motor fitted with a small gear at an axle thereof, and a large gear mounted to the main housing via a bearing, wherein the main housing is joined with the cylinder, the motor and the large gear are mounted to the main housing such that the small gear engages with the large gear, the large gear is provided with a counterweight being fixed with a crankpin, the piston body is pivotally mounted to the crankpin, the motor drives the crankpin to swing in a circle, which allows the piston body to conduct reciprocating motion within the cylinder to compress air in the inner space of the cylinder and force the compressed air to flow into the air storage unit; wherein the improvement comprises: the bearing is formed integrally with the main housing, so that when the piston body conducts reciprocating motion within the cylinder at high frequencies, the bearing is firmly fixed on the main housing, the counterweight is mounted in a central opening of the large gear and flush with the large gear to reduce the distance between the main housing and the cylinder, the main housing is provided with a first portion for mounting the motor and a second portion for holding the bearing, and a crankshaft is fixed at one end to the counterweight and mounted at the other end to the bearing, so that the large gear is capable of driving the crankpin to swing in a circle around crankshaft so as to drive the piston body to conduct reciprocating motion within the cylinder, a cooling fan is provided at a rear end of the axle of the motor for dissipating the heat generated from the reciprocating motion of the piston body, the main housing defines at least one through hole for guiding the air flow, generated by the cooling fan, to flow through the main housing, and the main housing is formed with two lateral walls and a bottom wall to form a wind collecting hood, wherein the second portion is located within the wind collecting hood and held by multiple radial braces formed between the second portion and the wind collecting hood so as to facilitate the air flow, generated by the cooling fan, being introduced through the main housing for rapidly dissipating the heat generated from the reciprocating motion of the piston body within the cylinder, thereby increasing the operational security.

2. The improved air compressor of claim 1, wherein each of the lateral walls of the main housing includes a curved upper section and a straight lower section so that the two lateral walls forms an inverted U-shaped structure, and the bottom wall of the main housing includes a C-shaped section and two short section at two opposite ends of the C-shaped section, the straight lower section of each lateral wall being joined with one of the short sections of the bottom wall.

3. The improved air compressor of claim 2, wherein both the cylinder and the main housing are made of plastic, and the cylinder is integrally formed with the main housing or joined with the main housing by using bonding technology.

4. The improved air compressor of claim 3, wherein the cylinder has a top wall and an open bottom, the air storage unit is formed on the top wall of the cylinder and provided with multiple connection fittings, the top wall of the cylinder defines a through hole communicating the air storage unit and the inner space of the cylinder, a valve plug is located in the air storage unit above the through hole of the top wall of the cylinder and biased by a compression spring thereon, whereby the motor is capable of driving the crankpin to swing in a circle, via the small gear and the large gear, for allowing the piston body to conduct reciprocating motion within the cylinder and thus produce compressed air that overcomes the biasing force of the compression spring to enter the air storage unit, so that the compressed air is deliverable to various application objects of different functions or features via the connection fittings of the air storage unit.

5. The improved air compressor of claim 4, wherein the top surface of the piston head is configured with a slope so as to reduce the force required for moving the piston body at BDC or MC, and increase the gas-tightness of the cylinder after the piston body passes BDC or TDC, so that the piston body conducts reciprocating motion more smoothly, thereby increasing the performance of compressing air.

6. The improved air compressor of claim 5, wherein the open bottom of the cylinder is divided into two halves according to a central vertical line of the cylinder, one half of the open bottom being horizontal while the other half of the open bottom being slanted and parallel to the top surface of the piston head when the piston body is at BDC, whereby when the piston body is at BDC, the piston head will be entirely within the open bottom of the cylinder, and thus will not escape from the cylinder, so that the operational security will be increased and the piston head will keep gas-tight with the inner surface of the surrounding wall of the cylinder, thereby increasing the performance of compressing air.

* * * * *